US007900721B2

(12) United States Patent
Sian

(10) Patent No.: US 7,900,721 B2
(45) Date of Patent: Mar. 8, 2011

(54) HARD METAL PLATE FOR ROCK DRILL AND ROCK DRILL

(75) Inventor: Kirpal Singh Sian, Blaustein (DE)

(73) Assignee: Irwin Industrial Tool Company, Huntersville, NC (US)

( * ) Notice: Subject to any disclaimer, the term of this patent is extended or adjusted under 35 U.S.C. 154(b) by 165 days.

(21) Appl. No.: 12/263,761

(22) Filed: Nov. 3, 2008

(65) Prior Publication Data

US 2010/0108400 A1 May 6, 2010

(51) Int. Cl.
*E21B 10/46* (2006.01)

(52) U.S. Cl. ..... 175/420.1; 175/415

(58) Field of Classification Search ..... 175/420.1, 175/415, 427

See application file for complete search history.

(56) References Cited

U.S. PATENT DOCUMENTS

| | | | | |
|---|---|---|---|---|
| 3,080,934 | A * | 3/1963 | Berscheid | 175/420.1 |
| 4,527,638 | A * | 7/1985 | Sanchez et al. | 175/57 |
| 6,021,857 | A * | 2/2000 | Birk et al. | 175/415 |
| 6,405,813 | B1 * | 6/2002 | Kleine et al. | 175/420.1 |
| 6,959,775 | B2 * | 11/2005 | Pedersen | 175/394 |
| 7,314,102 | B2 * | 1/2008 | Magin | 175/415 |

FOREIGN PATENT DOCUMENTS

| | | | |
|---|---|---|---|
| DE | 3809356 | A1 | 3/1988 |
| DE | 19730665 | A1 | 7/1997 |
| DE | 29904056 | U1 | 3/1999 |
| DE | 10006936 | A1 | 2/2000 |
| DE | 10208630 | A1 | 2/2002 |
| DE | 1965606 | A1 | 12/2009 |

OTHER PUBLICATIONS

German Patent Office, First Official Action, Jan. 11, 2008.

* cited by examiner

*Primary Examiner* — Hoang Dang
(74) *Attorney, Agent, or Firm* — Dennis J. Williamson; Moore & Van Allen, PLLC

(57) ABSTRACT

In a hard metal plate for insertion in to a seat formed at one end of a drill shaft of a rock drill, comprising a substantially rectangular base shape having two opposed long sides extending in the axial direction of the drill shaft which are at least partially covered by the seat, two opposed, substantially axial free short sides, a radial bottom side facing towards the seat and a cutting face facing away from the seat, both short sides are formed by an axial section having a purely axial direction component and a conical section inclined towards the axial direction, so that at the short side, the substantially rectangular plate tapers towards the bottom side.

26 Claims, 6 Drawing Sheets

HARD METAL PLATE FOR ROCK DRILL AND ROCK DRILL

Figure 1A:
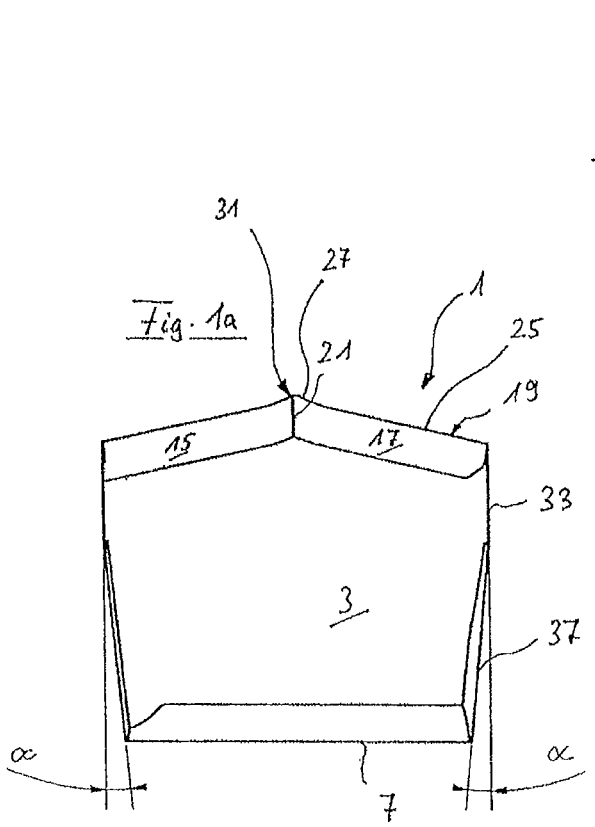

The invention relates to a hard metal plate for insertion in to a seat formed at one end of a drill shaft of a rock drill. The generic hard metal plate should comprise a substantially rectangular base having two opposed, in particular parallel long sides extending in the axial direction of the drill shaft. In the inserted state of the hard metal plate, the long sides are at least partially covered by the seat of the drill shaft. The long sides are configured to be flat. Furthermore, the rectangular basic shape is defined by two opposed, substantially axial free short sides, a bottom side facing towards the seat and a cutting face facing away from the seat.

Such hard metal plates have proved successful in practice since they are easy to manufacture and mount on the drill shaft. Such a hard metal plate is known, for example, from U.S. Pat. No. 3,089,552. The known hard metal plate is inserted in a slot at the end of the drill shaft. In a side view, the hard metal plate is provided with a roof-shaped cutting face with flattened tip. The cutting edges lie on the longitudinal transition edge between the cutting face and the long side, which precedes the longitudinal transition edge in the direction of rotation. The cutting edges are connected to one another by means of a central cutting edge in the flattened tip region. The known hard metal plate extends radially over the drill head of the drill shaft which receives the hard metal plate.

A further development of the known hard metal plate is given in EP 0 836 919 B1. According to this, both roof flanks of the cutting face of the hard metal plate are provided with stepped sections which run radially outwards from a projecting tip in an axially resetting manner. As a result of the stepped sections, a plurality of jagged initial cuts are formed. With this measure for increasing the drilling efficiency by means of producing a plurality of cutting edges at the cutting face, the disadvantage emerged that the life of such hard metal plates is significantly reduced.

It is the object of the invention to overcome the disadvantages of the prior art, in particular to optimise a hard metal plate for a rock drill having a substantially rectangular basic shape in particular having a roof-shaped cutting face in such a manner that the life of the hard metal plate is increased whilst ensuring a high drilling efficiency.

According to a first aspect of the invention, the two short sides are formed by an axial section having a purely axial direction component and a conical section inclined towards the axial direction, so that at the short side, the substantially rectangular plate tapers towards the bottom side. At this point, it may be noted that the pure axial section preferably opens axially linearly, i.e. free from bends, into the cutting face in a smooth angular manner in order to strength the hard metal plate at the cutting face with a maximum of hard metal material.

A particularly high drilling efficiency was established with this conicity at the bottom side of the hard metal plate. It was shown that the conicity at the bottom side favourably influences the removal of drilling dust. Despite the putative weakening at the bottom side, the lives of the hard metal plate are sufficiently high. The hard metal plate is strengthened in the area of the front face as a result of the unchanged axial section. It was surprisingly shown that the conicity of a bottom side increased the drilling efficiency of the hard metal plate insofar as a significant reduction in the drilling heat generated when cutting with the hard metal plate is achieved. This reduction in the heat generation was clearly the result of reduced friction between the material to be drilled and the hard metal plate because with the conicity, a substantially smaller part of the outer side of the hard metal plate is brought into engagement with the material to be drilled.

In a preferred embodiment, the conical section is inclined with respect to the axial direction by less than 10°, preferably by about 6°, wherein the angle of inclination of the axial section is approximately zero until this opens in to the cutting face. In this way, the hard metal plate is not centro-symmetric with regard to the conicity on the bottom side. With these inclinations, an optimum compromise was achieved between the life and efficient removal of drilling dust. The conical section preferably forms more than half, preferably a third of the axial length of the short side. The longer the conical section, the more any blockage in the area of the cutting face is avoided during drilling. Alternatively, the axial section can form more than half, preferably a third of the axial length of the short side, thus increasing the strength of the hard metal plate. In a further development of the invention, the conical section and the axial section are convexly curved and in particular are separated from one another by a form kink. In this way, the strength of the hard metal plate is increased.

In a preferred embodiment of the invention, the conical section is faceted towards the long side in order to thereby further reduce the friction between the hard metal plate and the material to be drilled.

Particularly good removal properties were then achieved if the conical section runs linearly in the axial direction from the axial section towards the bottom side.

According to a second aspect of the invention, a concave groove extending linearly in the axial direction is preferably formed on at least one long side, preferably in each case on both long sides. The axially extending linear groove defines a locally fixed removal channel for drilling dust from the cutting face. It was surprisingly found that very good removal properties are obtained by the purely axial linear groove guide. A helical groove guide extending in the coil of the drill shaft is not necessary for this purpose. As a result of the linearity of the removal groove, the hard metal plate according to the invention with improved drilling dust removal properties can be produced very simply and cost-effectively.

The groove preferably extends directly away from the cutting face and the groove opens along the linear axial profile into the bottom side. As a result of the conical section according to the first aspect of the invention, the groove can be reduced in the axial direction.

Particularly good properties with regard to removal of drilling dust whilst ensuring an indicated seat of the hard metal plate on the drill shaft were achieved if the groove is formed on the long side at a transition between the long side and adjacent short side.

A further aspect of the invention relates to the cutting face which should comprise two long cutting edges. The cutting edges meet in a tip region and each comprise an edge section close to the tip region and an edge section remote from the tip region. Both edge sections are inclined towards a radial direction perpendicular to the axial direction. According to the invention, the edge section close to the tip region is more strongly inclined than the edge section remote from the tip region wherein a transition region between the edge section close to the tip region and the edge section remote from the tip region is continuously concavely curved.

As a result of the different inclinations of the two long cutting edge sections at the cutting face, a significant increase in the drilling efficiency is achieved. In addition, with the continuously curved transition between the two differently inclined cutting edge sections, the life of the hard metal plate is not adversely affected or barely adversely affected despite the increase in the drilling efficiency.

In a preferred embodiment of the invention, the long cutting edges each consist of a linear edge section close to the tip region and a linear edge section remote from the tip region.

In a further development, the edge section remote from the tip region is inclined with respect to the associated radial direction by about 5° to 20°, preferably by about 12° or 13°. Furthermore, the edge section close to the tip region is more than twice as steeply inclined with respect to the associated radial direction by about 25° to 35°, preferably by about 29°.

Optimisation of the drilling efficiency is achieved if the linear edge section remote from the tip region is many times longer than the linear edge section close to the tip region, preferably five times, seven times or ten times as long.

Furthermore, the cutting face can comprise two short cutting edges which extend substantially linearly from the respective long side of the hard metal plate into the tip region with the same inclination towards the radial direction. In this case, the short cutting edges can be inclined with respect to the associated radial direction by about 25° to 35°, preferably about 31° or 32°.

In a further development of the invention, the long cutting edges separate two mutually inclined front flanks which are delimited by an adjacent short cutting edge and are inclined according to the relevant long cutting edge and short cutting edge.

The course of the long and/or short cutting edges at the cutting face is preferably point-symmetrical to the tip region which is crossed by an axis of rotation of the hard metal plate.

In a further aspect of the invention, the generic hard metal plate is further developed in that when considered in an axial projection, two long cutting edges extending linearly radially outwards from a common tip region, which open in a linear course in the respective short side, are inclined to a flat radial extension of the long sides, which are parallel to one another, at a non-negligible angle greater than 1° and less than 10°. The long cutting edges are preferably inclined to the flat radial extension of the flat sides by 5° or 6°. In this way, the life and the drilling efficiency of the hard metal plate can surprisingly be increased.

In a further aspect of the invention, both short sides of the hard metal plate are formed by a substantially flat side section remote from the bottom side and a stepped side section close to the bottom side with at least two steps which in particular radially set back the hard metal plate towards the bottom side.

It was surprisingly found that an improved drilling dust removal performance is achieved with a back-setting on the short side section of the hard metal plate facing away from the cutting face. In this way, the drilling efficiency is significantly increased without needing to accept losses in regard to the life of the hard metal plate. The hard metal plate preferably tapers in the axial course of the stepped side section towards the bottom side. The longitudinal extension of the hard metal preferably decreases in the radial direction towards the bottom side. The stepped side section, in particular each step, is defined by a radial jump surface and an axial pedestal surface in the axial course. In this case, the pedestal surface can be larger than the jump surface, in particular is twice as large or three times as large as the jump surface.

Particularly good drilling dust removal properties are achieved if the pedestal surface is slightly inclined with respect to the axial direction, in particular between 1° and 20°.

In a preferred embodiment of the invention, the front side is substantially pyramid-shaped.

It is clear that the aforesaid aspects of the hard metal plate according to the invention can be combined with one another.

The invention further relates to a rock drill having a drill shaft, one end whereof can be firmly inserted in a drill and the other end whereof comprises a seat for firmly receiving a hard metal plate according to the invention. The concave groove of the hard metal plate extending linearly in the axial direction is preferably not covered by the retaining flanks of the seat of the drill shaft. The hard metal plate is dimensioned in such a manner that it protrudes radially beyond the drill shaft at least in the area of its cutting face especially at the axial height of the axial section. A transition between the hard metal plate and the drill shaft at the axial height of the bottom side of the hard metal plate is preferably continuous in the radial direction, in particular is free from shoulders.

Figure 1B:
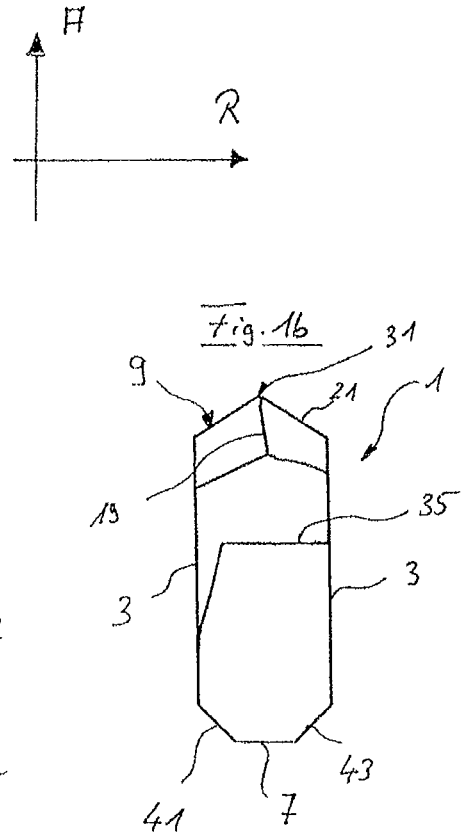
Figure 1C:
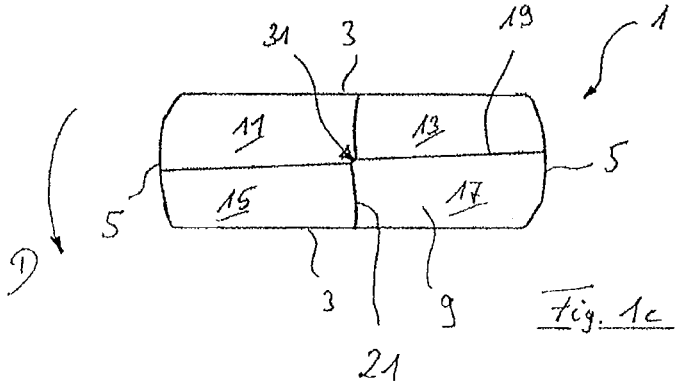

Further advantages, properties and features of the invention will become apparent from the following description of preferred embodiments of the invention with reference to the appended drawings in which:

FIG. 1*a* shows a long side view of a hard metal plate according to the invention in a first embodiment;

FIG. 1*b* shows a short side view of the hard metal plate according to FIG. 1;

FIG. 1*c* shows a cutting face view of the hard metal plate according to FIGS. 1*a* and 1*b;*

Figure 1D:
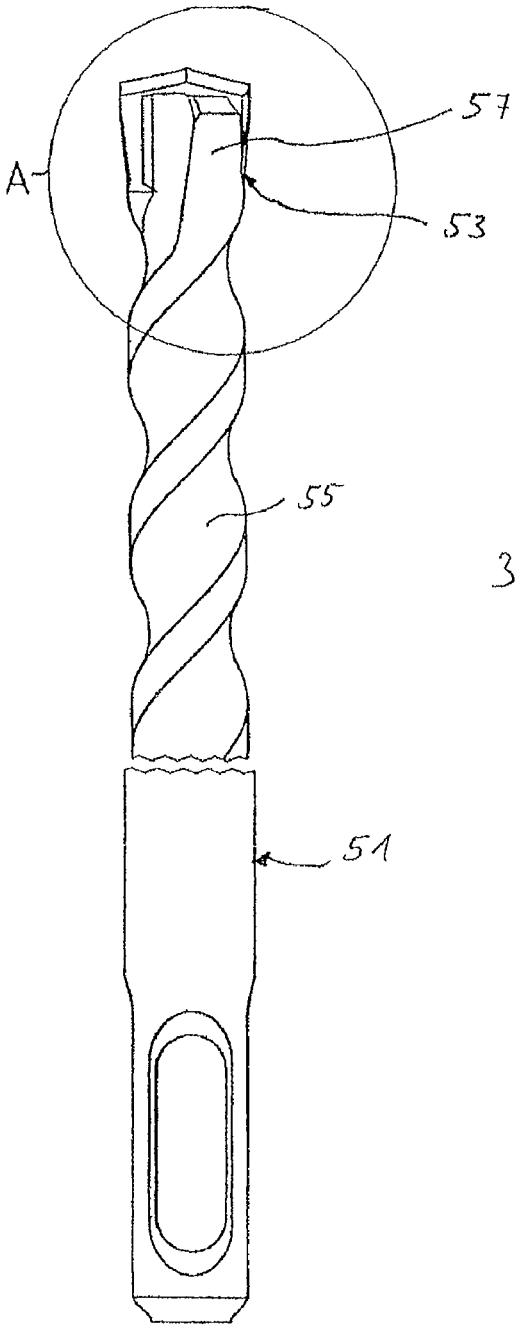
Figure 1E:
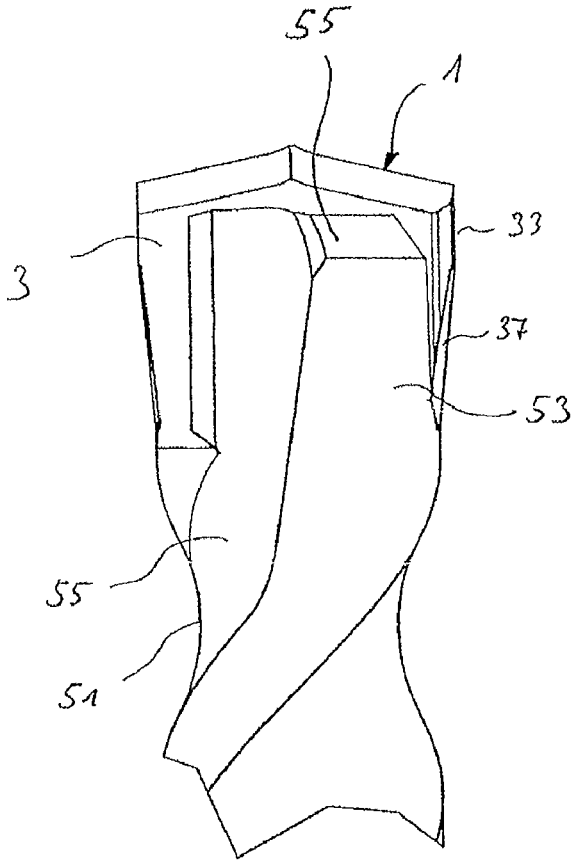

FIG. 1*d* shows a side view of the rock drill according to the invention;

FIG. 1*e* shows a detail view A of the rock drill according to FIG. 1*d;*

Figure 2B:
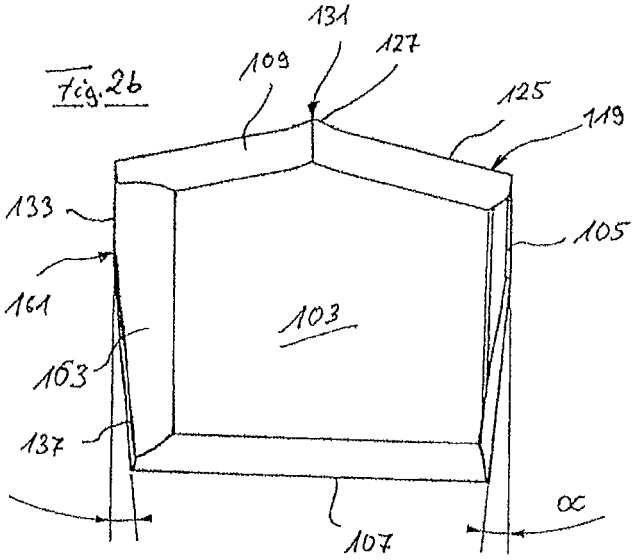
Figure 2C:
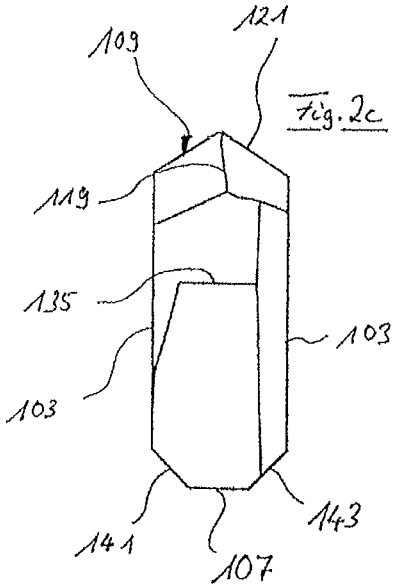
Figure 2D:
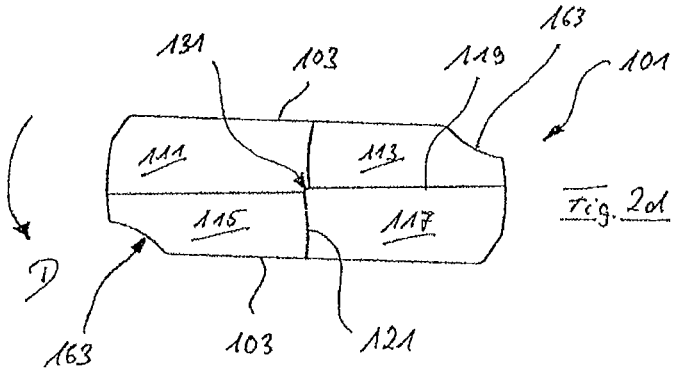
Figure 2A:
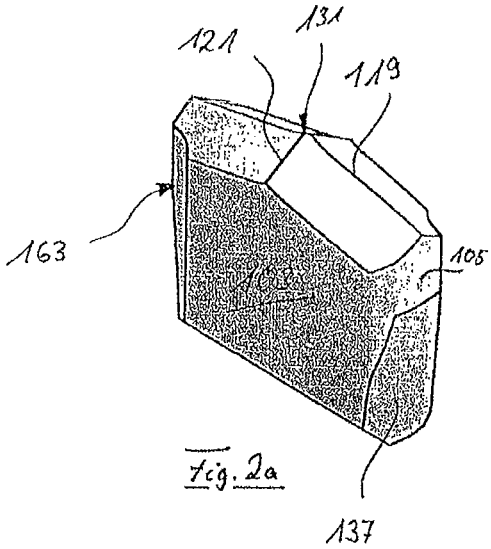

FIG. 2*a* shows a perspective view of a hard metal plate according to the invention in a second embodiment;

FIG. 2*b* shows a long side view of the hard metal plate according to FIG. 2*a;*

FIG. 2*c* shows a short side view of the hard metal plate according to FIGS. 2*a* and 2*b;*

FIG. 2*d* shows a front face view of the hard metal plate according to FIGS. 2*a* to 2*c;*

Figure 2E:
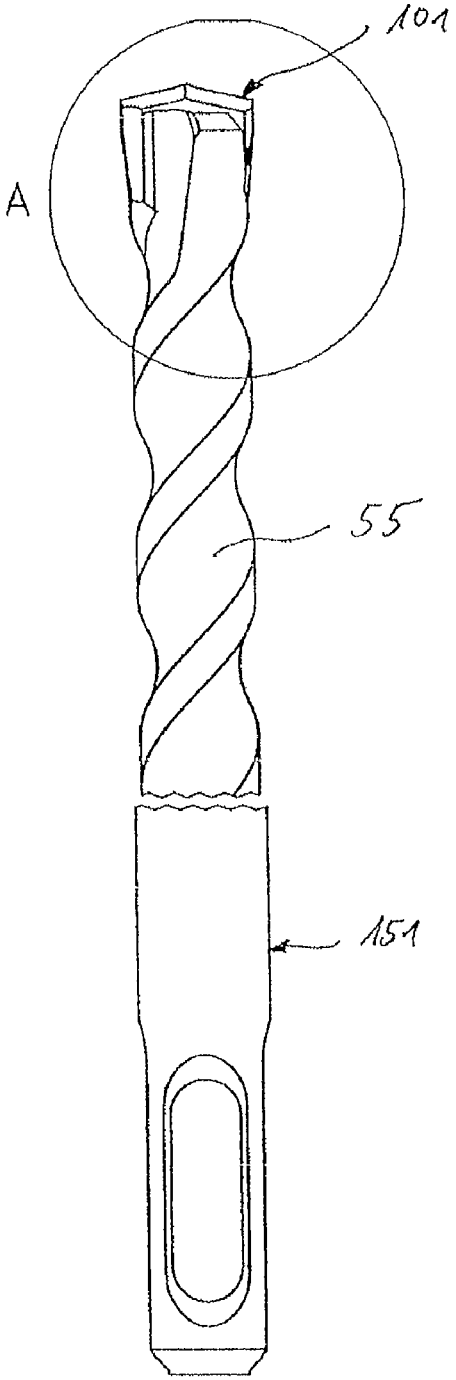

FIG. 2*e* shows a side view of the rock drill with the hard metal plate according to FIGS. 2*a* to 2*d;*

Figure 2F:
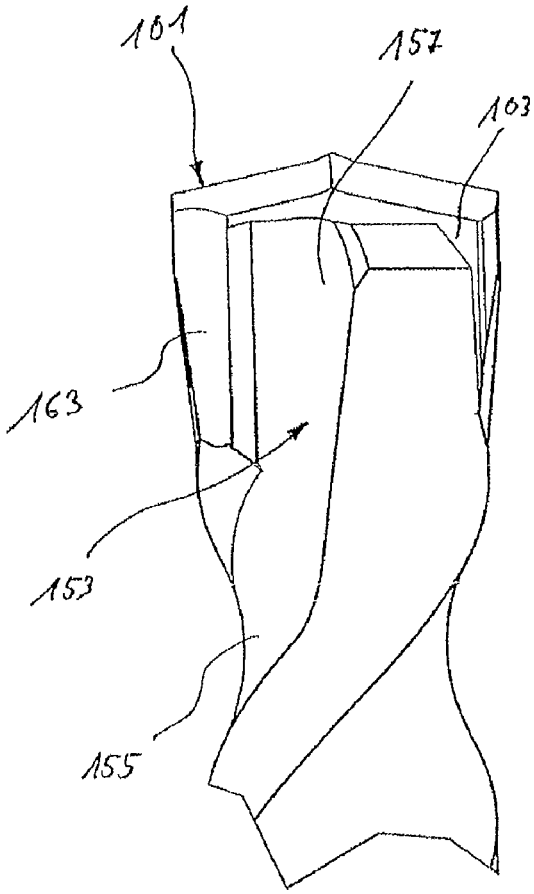

FIG. 2*f* shows a detail view A according to FIG. 2*e;*

Figure 3A:
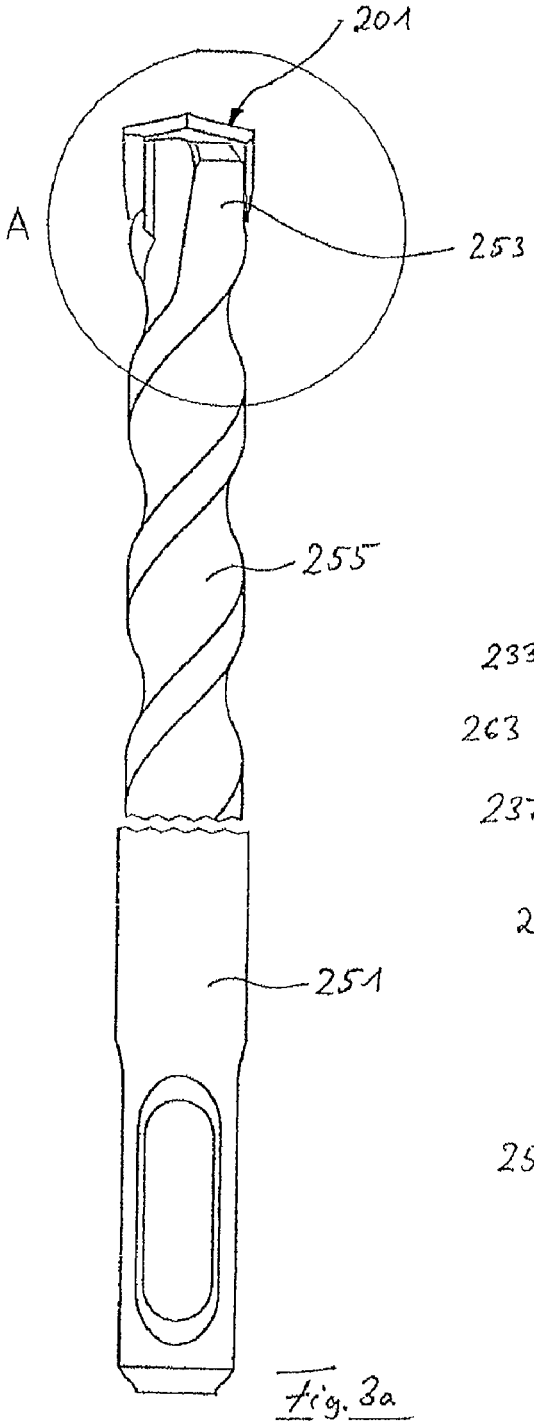
Figure 3B:
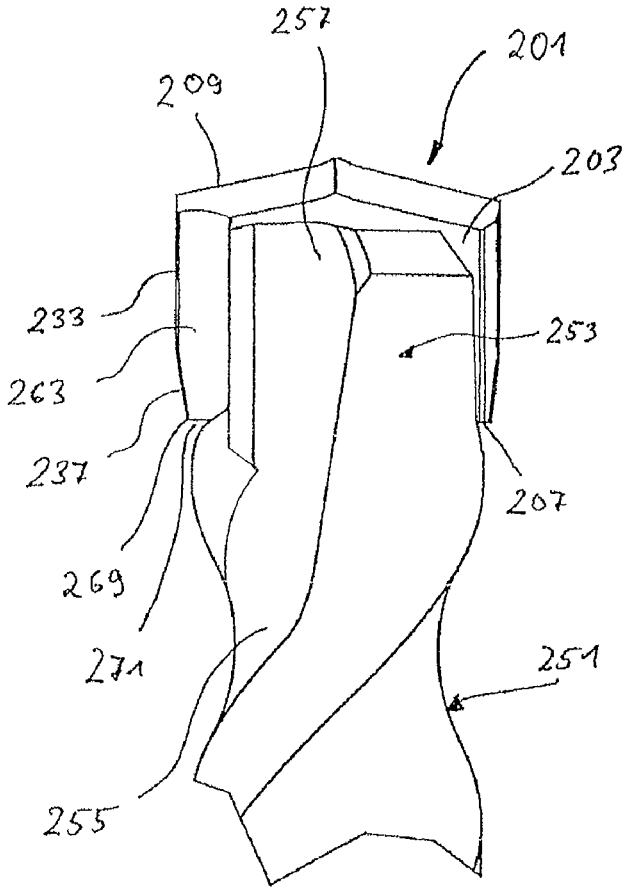

FIG. 3*a* shows a side view of a rock drill according to the invention with a hard metal plate in a third embodiment;

FIG. 3*b* shows a detail view A according to FIG. 3*a;*

Figure 4A:
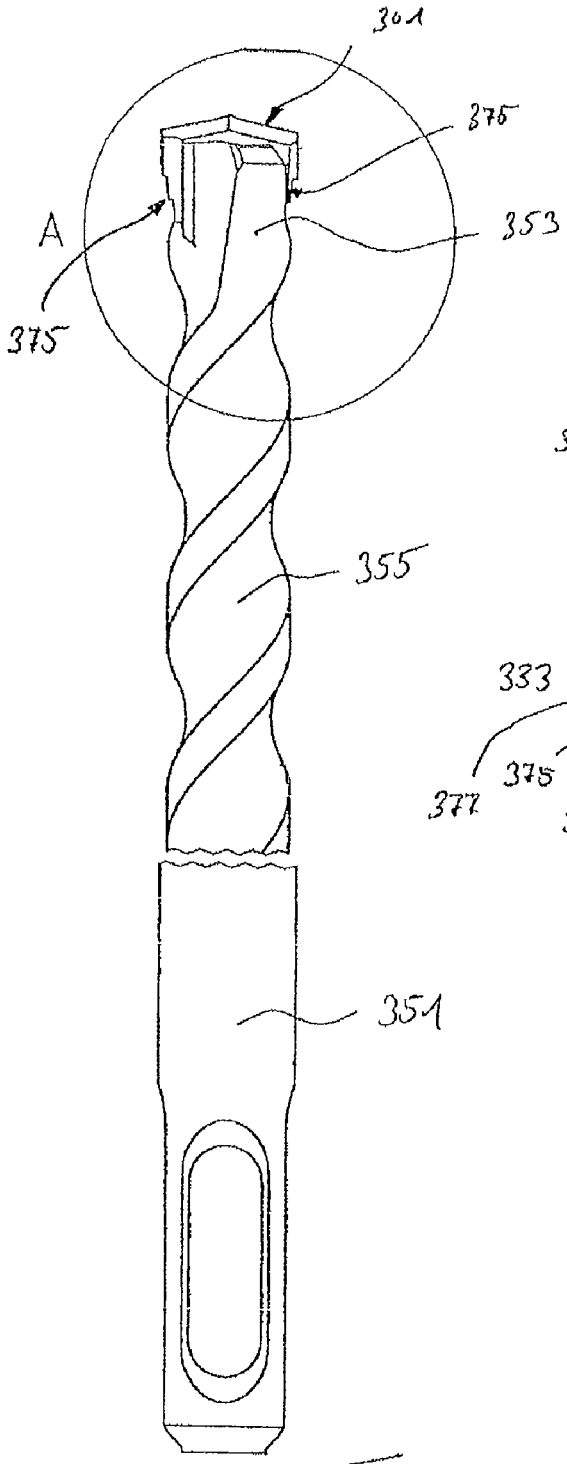
Figure 4B:
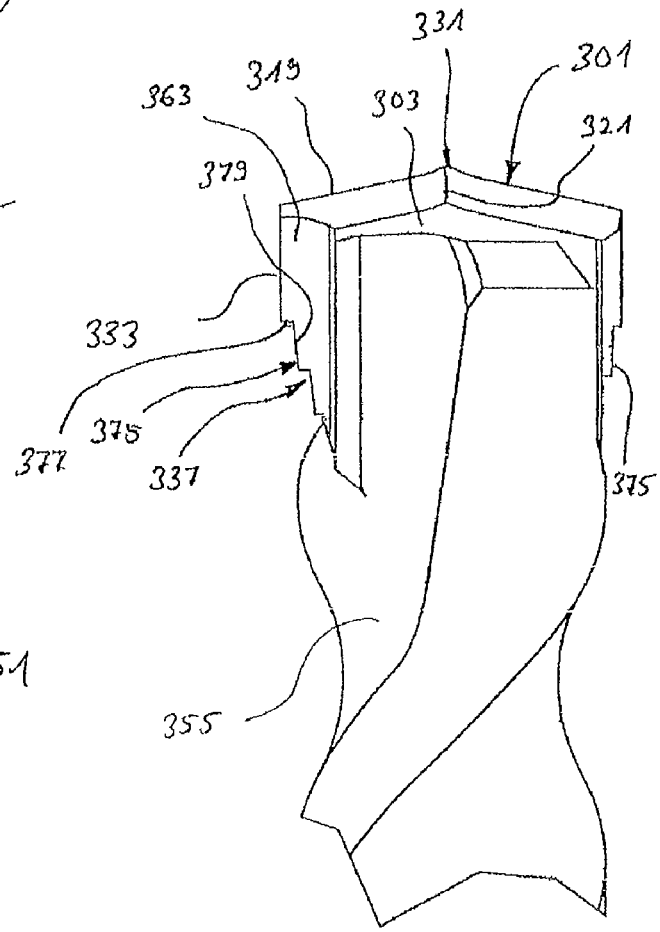

FIG. 4*a* shows a side view of a rock drill according to the invention with a hard metal plate in a fourth embodiment;

FIG. 4*b* shows a detail view A according to FIG. 4*a*.

In FIG. 1, the hard metal plate in a first embodiment according to the invention is generally provided with the reference numeral 1. The hard metal plate 1 has a substantially rectangular base structure, as can be seen in particular in FIGS. 1*c* and 1*b*. The substantially rectangular base structure should be defined by two opposing long sides 3, parallel to one another, having flat side faces and by two opposing short sides 5 having slightly concavely curved side faces. A bottom side 7 which is orthogonal both to the short sides 5 and also to the long sides 3, and a substantially roof-shaped front side 9 in side view are located opposite to one another and have the same radial surface extension in axial projection.

The front side 9, when viewed three-dimensionally, has a substantially pyramidal form with four flat cutting flank sections 11 to 17 which are each delimited by the long side 3, the short side 5, a main cutting edge 19 and a short cutting edge 21.

As shown in FIG. 1*a*, the front-side region of the hard metal plate 1 is configured as roof-shaped, wherein the main cutting edge 19 has a linear edge section 25 near the short side and a linear shorter edge section 27 remote from the short side. The inclination of the edge section 27 remote from the short side with respect to a radial direction R is significantly greater than the inclination of the edge section 25 near the short side. The angle of inclination between the edge section 27 remote from the short side and the radial direction R is around 29° whereas the angle of inclination of the edge section 25 near the short side is around 13°.

The transition between the linear edge section 27 remote from the short side and the edge section 25 near the short side is continuously convexly curved without forming an edge, as shown in FIG. 1*a*.

The long cutting edge 19 crosses the short cutting edge 21 in a tip region 31. The short cutting edge 21 is slightly curved in sections so that when observing both short cutting edge sections, a slight S shape can be identified. On the other hand, when viewed in axial projection, the long cutting edge 19 extends from the respective short side 5 to the tip region 31 and continues linearly and slightly offset towards the opposite short side 5.

In the course of the axial direction A from the front side 9, the short side 5 has an axial section 33 which substantially accounts for one third of the total axial length of the short side 5. The axial section 33 is adjoined by a conical section 37, forming a transition edge 35, which substantially accounts for two thirds of the total axial length of the short side 5. The conical section 37 runs substantially linearly in the axial direction A and forms an angle $\alpha$ of about 6° with respect to the axial direction A.

The bottom side 7 has two chamfers 41, 43 accounting for a third of the total width of the bottom side 7, having an angle of about 45° to the bottom side, which facilitates the insertion of the hard metal plate 1 into a slot in a drilling head of a drill shaft 51 (see FIG. 1*d*).

FIGS. 1*d* and 1*e* show the hard metal plate 1 inserted in the slot on the drilling head 53 of the drill shaft 51.

As can be seen, the hard metal plate 1 goes over continuously into the drill shaft 51 free from transitions and shoulders. The spiral-shaped helical groove 55 of the drill shaft 51 runs out linearly on the drilling head 53. The drilling head 53 comprises two opposing slit-forming flanks 57 having parallel inner faces (not shown in detail) which for the most part cover the long sides 3 of the hard metal plate 1 in extensive contact. In the course of the conical section 37 and on the axial section 33 the hard metal plate 1 protrudes radially beyond the radial dimension of the drill shaft 51.

As can be seen in FIG. 1*c*, the long cutting edge 19 extends substantially in a radial direction R. However, the main cutting edge 19 does not extend parallel to the radial extension of the long side 3 but is slightly inclined thereto. In this way, when viewing a direction of rotation D, the trailing cutting flank sections 11, 17 are designed to be stronger than the leading cutting flank sections 13, 15.

FIGS. 2*a* to 2*f* show another embodiment of the hard metal plate for a rock drill according to the invention, wherein for better legibility of the description of the figures, the same reference numerals as those of the embodiment according to FIGS. 1*a* to 1*e*, increased by 100, are used for identical and similar components of the hard metal plate and rock drill according to FIGS. 2*a* to 2*f*.

The hard metal plate 101 shown in FIGS. 2*a* to 2*f* differs from the hard metal plate 1 according to FIGS. 1*a* to 1*f* in that an axial groove 163 is formed on the leading edge region 161 of the long side 103 in the direction of rotation D, which groove extends linearly axially from the front face 109 to the bottom side 107. The groove 163 is concavely curved and occupies approximately ⅙ of the width of the long side 103 of the hard metal plate 101. In the area of the axial section 133 of the short side 105, the groove 163 has a constant width which decreases on the conical section 137 towards the bottom side 107 according to the conicity. A transition between the groove 163 and the conical section 137 can be configured as angular, wherein alternatively this transition can be configured without a hard edge suitably rounded and continuous in form.

The groove 163 is used to remove drilling dust produced during the cutting of rock, from the cutting zone axially towards the drilling shaft 151, in particular towards the drilling dust groove 155.

As can be seen from FIG. 2*f*, the groove 163 opens continuously into the drilling dust groove 155. Furthermore, it can be seen from FIG. 2*f* that the slotted flank 157 of the drilling head 157 approximately occupies the entire flat side 103, wherein the groove 163 remains unoccupied by the slotted flank 157 so as to ensure unhindered removal of drilling dust from the axial groove 163 towards the helical groove 155.

FIGS. 3*a* and 3*b* show another preferred embodiment of the hard metal plate for a rock drill according to the invention, wherein for better legibility of the description of the figures, the same reference numerals as those of the embodiment according to FIGS. 1*a* to 1*e*, or 2*a* to 2*f*, increased by 200 or 100, are used for identical and similar components of the hard metal plate and rock drill.

The hard metal plate 201 differs from the hard metal plate 101 according to FIGS. 2*a* to 2*f* in that the axial section 233 substantially accounts for ⅔ of the total length of the short side 205. On the other hand, the conical section 237 accounts for only about ⅓ of the axial length of the short side 205. As a result of this weaker conicity compared with the embodiment according to FIGS. 2*a* to 2*f*, a shoulder 269 is formed on the bottom side 7 which defines a substantially triangular intermediate space 271 between the drill shaft 251 and the bottom side 207 of the hard metal plate 201.

The jump-like transition between the hard metal plate 201 and the drill shaft 251 promotes the removal of the drilling dust from the front side 209 towards the drilling dust groove 255 during the drilling process. The wedge-shaped intermediate space thereby produces a pump effect which additionally propels the drilling dust from the groove 263 into the drilling dust groove 255 of the drill shaft 251.

FIGS. 4*a* and 4*b* show another preferred embodiment of the hard metal plate for a rock drill according to the invention, wherein for better legibility of the description of the figures, the same reference numerals as those of the embodiment according to FIGS. 1*a* to 1*e*, or 2*a* to 2*f*, or 3*a* and 3*b*, increased by 300 or 200 or 100, are used for identical and similar components of the hard metal plate.

The hard metal plate 301 differs from the hard metal plates 201 and 101 in that the axial section 333 extends over half the axial length of the short side 305 of the hard metal plate 301. The conical section 337 is achieved by forming a step arrangement 375 having at least three steps, which define three radial jump faces 377 and three axial pedestals 379. The axial pedestal 379 is slightly inclined with respect to the axial direction A.

The step structure on the conical section 337 facilitates the removal of drilling dust from the front side 109 of the hard metal plate 101.

The features disclosed in the preceding description, the figures and the claims can be important both singly and in any combination for implementing the invention in the different embodiments.

REFERENCE LIST

| | |
|---|---|
| 1, 101, 201, 301 | Hard metal plate |
| 3, 103, 203, 303 | Long sides |
| 5, 105, 205, 205 | Short sides |
| 7, 107, 207, 307 | Bottom side |
| 9, 109, 209, 309 | Front side |
| 11 to 17, 111 to 117, 211 to 217, 311 to 317 | Cutting flank sections |
| 19, 119, 219, 319 | Main cutting edge |
| 21, 121, 221, 321 | Short cutting edge |
| 25, 125, 225, 325 | Edge section near short side |
| 27, 127, 227, 327 | Edge section remote from short side |
| 31, 131, 231, 331 | Tip region |
| 33, 133, 233, 333 | Axial section |
| 35, 135, 235, 335 | Transition edge |
| 37, 137, 237, 337 | Conical section |
| 41, 43, 141 143, 241, 243, 341, 343 | Chamfers |
| 51, 151, 251, 351 | Drilling shaft |
| 53, 153, 352, 353 | Drilling head |
| 55, 155, 255 | Helical groove |
| 57, 157 257, 357 | Slotted flank |
| 161, 162, 362 | Edge region |
| 163, 263 | Drilling dust groove |
| 269 | Shoulder |
| 375 | Step arrangement |
| 377 | Radial jumps |
| 379 | Axial pedestal |
| A | Axial direction |
| R | Radial direction |
| α | Angle |

The invention claimed is:

1. A rock drill comprising: a hard metal plate inserted into a seat formed at one end of a drill shaft, said drill shaft having a radial dimension defining a first side and a second side of the drill shaft and an axial direction, and said hard metal plate comprising a substantially rectangular base shape having two opposed long sides extending in the axial direction of the drill shaft which are at least partially covered by the seat, two opposed, substantially axial free short sides, a radial bottom side facing towards the seat and a roof-shaped cutting face facing away from the seat, wherein both short sides are formed by an axial section having a purely axial direction component and a conical section inclined towards the axial direction, so that at the short side, the substantially rectangular plate tapers towards the bottom side wherein the hard metal plate protrudes radially beyond both the first side and the second side of the drill shaft such that a portion of the long sides are exposed beyond both the first side and the second side of the drill shaft.

2. The rock drill of claim 1, wherein the conical section is inclined with respect to the axial direction by less than 10°.

3. The rock drill of claim 1, wherein the conical section forms more than half of the short sides.

4. The rock drill of claim 1, wherein the axial section opens axially linearly into the cutting face and forms less than half of the short sides.

5. The rock drill of claim 1, wherein the conical section and the axial section are separated from one another by a transition edge.

6. The rock drill of claim 1, wherein the conical section extends linearly in the axial direction from the axial section towards the bottom side.

7. The rock drill of claim 1 further comprising a concave groove extending linearly in the axial direction formed on at least one long side.

8. The rock drill of claim 7, wherein the groove extends away from the cutting face and opens along a linear profile into the bottom side.

9. The rock drill of claim 7, wherein the groove diminishes radially in the axial direction in the conical section.

10. The rock drill of claim 7, wherein the groove lies at a transition to the adjacent short side.

11. The rock drill of claim 1, wherein the cutting face comprises two long cutting edges which meet in a tip region and each of the two long cutting edges comprise an edge section close to the tip region and an edge section remote from the tip region, wherein both the edge section close to the tip region and an edge section remote from the tip region are inclined towards a radial direction perpendicular to the axial direction, wherein the edge section close to the tip region is more strongly inclined than the edge section remote from the tip region and a transition region between the edge section close to the tip region and the edge section remote from the tip region is continuously concavely curved.

12. The rock drill of claim 11, wherein the edge section remote from the tip region is inclined with respect to the radial direction by about 5° to 20°.

13. The rock drill of claim 11, wherein the edge section close to the tip region is inclined with respect to the radial direction by about 25° to 35°.

14. The rock drill of claim 11, wherein the linear edge section remote from the tip region is at least five times longer than the linear edge section close to the tip region.

15. The rock drill of claim 11, wherein the cutting face comprises two short cutting edges which extend substantially linearly from the long sides into the tip region with the same inclination towards the radial direction.

16. The rock drill of claim 15, wherein the short cutting edges are inclined with respect to the radial direction by about 25° to 35°.

17. The rock drill of claim 1, wherein the cutting face comprises two long cutting edges extending linearly radially outwards from a common tip region, which open in a linear course in the respective short side, and are inclined to a flat radial extension of the long sides at an angle greater than 1° and less than 10°.

18. The rock drill of claim 1, wherein the two short sides are formed by a substantially flat side section remote from the bottom side and a stepped side section close to the bottom side, said stepped side section in the conical section comprising at least two steps.

19. The rock drill of claim 18, wherein the stepped side section comprises a radial jump surface and an axial pedestal surface.

20. The rock drill of claim 19, wherein the pedestal surface is at least twice as large as the jump surface.

21. The rock drill of claim 19, wherein the pedestal surface is inclined between 1° and 20° with respect to the axial direction.

22. The rock drill of claim 1, wherein the conical section is inclined with respect to the axial direction by about 6°.

23. The rock drill of claim 11, wherein the edge section remote from the tip region is inclined with respect to the radial direction by about 12° to 13.

24. The rock drill of claim 11, wherein the edge section close to the tip region is inclined with respect to the radial direction by about 29°.

25. The rock drill of claim 15, wherein the short cutting edges are inclined with respect to the radial direction by about 31° to 32°.

26. The rock drill of claim 1, wherein the cutting face comprises two long cutting edges extending linearly radially outwards from a common tip region, which open in a linear course in the respective short side, and are inclined to a flat radial extension of the long sides at an angle of about 5° to 6°.

* * * * *